US005234114A

United States Patent [19]

Coffey

[11] Patent Number: 5,234,114

[45] Date of Patent: Aug. 10, 1993

[54] GOLFING EQUIPMENT CARRIER

[76] Inventor: Daniel Coffey, 1710 Esplanade, Apt. H, Redondo Beach, Calif. 90277

[21] Appl. No.: 874,068

[22] Filed: Apr. 24, 1992

[51] Int. Cl.[5] ..... A47F 7/00

[52] U.S. Cl. ..... 211/70.2; 211/14; 206/315.2

[58] Field of Search ..... 211/70.2, 14; 206/315.2, 315.9; 224/918, 919

[56] References Cited

U.S. PATENT DOCUMENTS

| | | | |
|---|---|---|---|
| 1,648,565 | 11/1927 | Primley . | |
| 1,973,819 | 9/1934 | Link . | |
| 2,990,865 | 7/1961 | Steele | 211/70.2 |
| 3,128,021 | 4/1964 | Habbena . | |
| 3,156,000 | 11/1964 | Westhoff . | |
| 3,215,181 | 11/1965 | Reed | 206/315.2 X |
| 3,415,572 | 12/1968 | Zagwyn | 211/70.2 X |
| 3,799,331 | 3/1974 | White . | |
| 4,032,054 | 6/1977 | Duncan . | |
| 4,036,416 | 7/1977 | Lowe | 211/70.2 X |
| 4,282,912 | 8/1981 | Brown . | |
| 4,350,194 | 9/1982 | Brown . | |
| 4,570,894 | 2/1986 | Miele . | |
| 4,666,038 | 5/1987 | Minneman | 206/315.2 |
| 4,747,490 | 5/1988 | Smith | 206/315.2 X |
| 4,890,731 | 1/1990 | Mroz | 206/315.9 |

FOREIGN PATENT DOCUMENTS

| | | | |
|---|---|---|---|
| 559144 | 6/1958 | Canada | 211/70.2 |

*Primary Examiner*—Robert W. Gibson, Jr.
*Attorney, Agent, or Firm*—James M. Ritchey

[57] ABSTRACT

Provided is a golfing equipment carrier having a housing constructed from a cover member mated to a base member. A rotatable supporting foot is included in the housing. Within the base member is an internal storage volume for retaining golf balls and other small golfing items. Associated with the housing are clamps for reversibly securing golf club shafts.

20 Claims, 7 Drawing Sheets

GOLFING EQUIPMENT CARRIER

BACKGROUND OF THE INVENTION

1. Field of the Invention

Related is an equipment carrier and storage device. Specifically, a golfing equipment carrier is disclosed. The subject apparatus comprises a central housing having several attachment means for holding golfing items such as clubs, balls, tees, glove, pencil, score card, and the like.

2. Description of the Background Art

Various inventions have been developed for transporting small items used in activities such as golfing, fishing, and the like. To participate in activities such as golfing and fishing an elongated object having a shaft is required (golf clubs or a fishing rod). Previous transportation devices have focused on carrying the small items and not the elongated, shaft containing objects.

In golfing, numerous devices exist for aiding a golfer in transporting and storing items relating to the sport of golf. In particular, traditional golf bags have existed for many decades. Generally, a golf bag is large and designed to contain a complete set of golf clubs, a large number of balls and tees, and most other articles the golfer might need under various types of weather and terrain conditions. Such a golf bag is usually quite heavy and is most often carried by means of a golf cart.

In particular, U.S. Pat. No. 1,648,565 discloses a golf ball carrier having a belt for wearing by a golfer. Attached to the belt is a pouch having a main compartment and several associated holders for small golfing items.

U.S. Pat. No. 1,973,819 relates a golfer's kit having a central hollow body for containing cigarettes, cigars, and the like. Secured to the central body is a pencil holding clip for anchoring a score card to a planar surface. Apertures in the body are for storing tees.

A ball cleaner attachment for a golf cart is described in U.S. Pat. No. 3,156,000. Brush lined ball cleaning chambers exist within a body. Pencil and smoking item holders are fitted proximate a flat planar writing surface of the body. A score card is secured by means of a clip to the writing surface of the device.

Disclosed within U.S. Pat. No. 3,128,021 is a tray for golf carts. Secured to a planar writing surface is a lower compartment for holding a plurality of golf balls. Holding in the balls is a swiveling member mounted to the planar surface. Tees fit in a series of apertures in the planar surface. Additionally, pencil, score card, and cigarette package holders are formed in the planar surface.

U.S. Pat. No. 3,799,331 presents a golfer's pocket kit. Compartments, accessed by sliding apart the two main halves of the device, are provided for matches, cigarettes, and a pencil. Apertures for holding tees and position markers or spotters are formed in the outer surfaces of the device.

U.S. Pat. No. 4,032,054 relates a golf article carrier detachably secured to a golf bag. A planar member extends at an angle from a body having a holder for a drinking container. Mounted either between the container holder and the planar surface or on the planar surface are means for securing two balls, tees, pencil, cigarettes, score card, and a ball marker.

A universal golf bag is disclosed in U.S. Pat. Nos. 4,282,912 and 4,350,194. A central cylinder has fittings for receiving various detachable pockets.

Lastly, U.S. Pat. No. 4,570,894 describes an umbrella holder for a golf cart. A body extends into a rotatable mounting that is secured to a golf cart handle. Within the body are two apertures, one for holding a retracted umbrella and a second for holding an opened umbrella. Means are provided for allowing the user to adjust the relative position of the device on the cart.

SUMMARY OF THE INVENTION

An object of the present invention is to provide a lightweight and easily portable equipment carrier that reversibly secures a shaft of an elongated object.

Another object of the present invention is to produce a golf equipment carrier having means for holding a plurality of golf clubs, in addition to various small golfing items.

A further object of the present invention is to relate a golf equipment carrier having a pivotable foot for supporting the carrier when a user sets down the carrier.

Still another object of the present invention is to provide a small and compact golf carrier having detachable golf club holding means.

Yet a further object of the present invention is to produce a golf equipment carrier adapted for direct carrying by a user or for attachment to a golf cart.

Disclosed is a golfing equipment carrier comprising a housing having a cover member hinged to a base member and secured in a closed position by a latch associated with the cover and base members. The base member has an internal storage volume and means associated with the internal storage volume for retaining a plurality of golf balls. Additional means are detachably associated with the base member for reversibly securing a shaft of each of a plurality of golf clubs. A compartment is formed within the base member for storing small golfing items and a supporting foot is pivotally secured to the base member. Attached to the housing is an interchangeable handle member. Included in the cover is a system for securing a score card writing instrument, and tee.

Other objects, advantages, and novel features of the present invention will become apparent from the detailed description that follows, when considered in conjunction with the associated drawings.

DESCRIPTION OF THE PREFERRED EMBODIMENT

Figure 1:
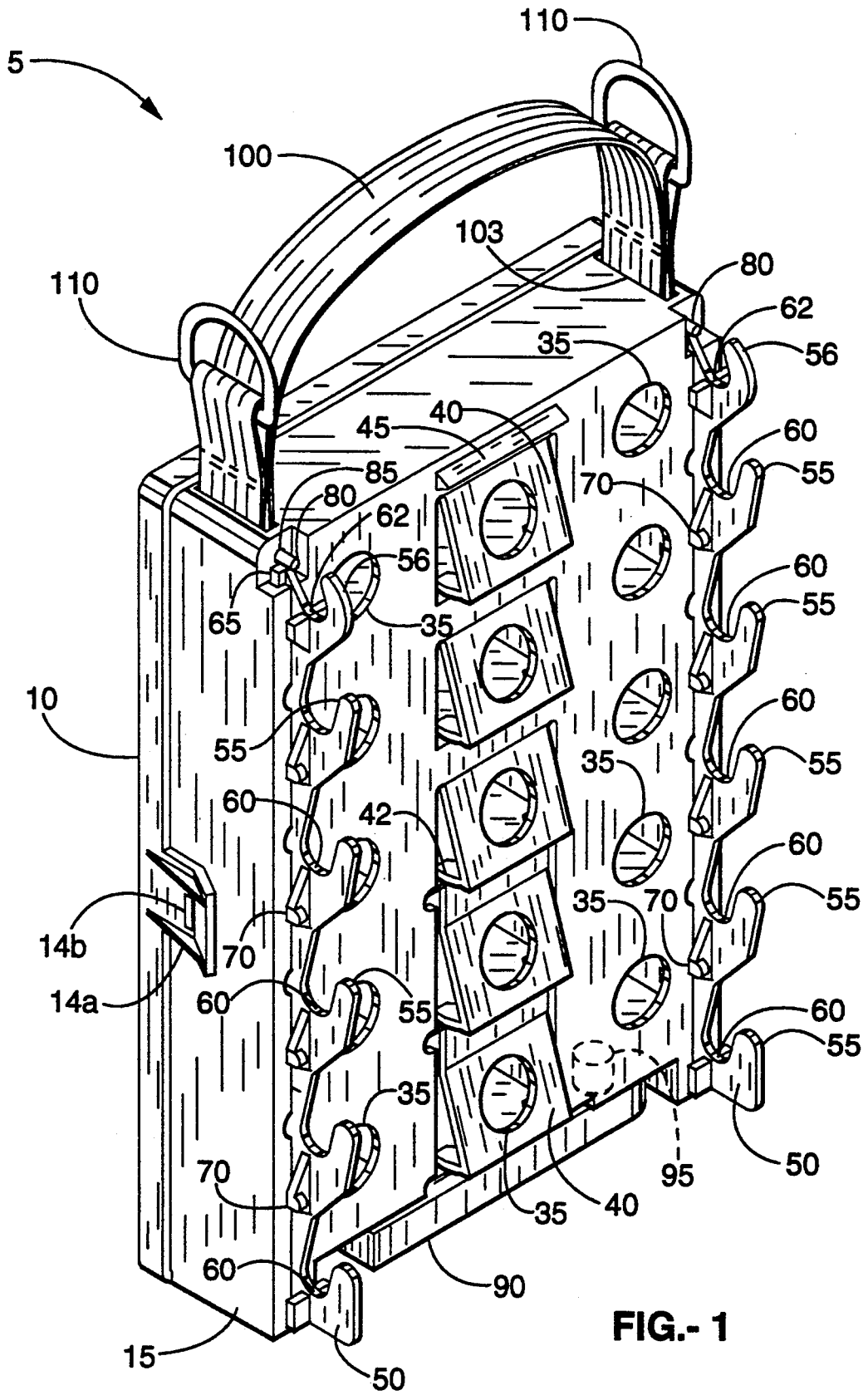
FIG. 1 is a perspective view of the subject apparatus.
Figure 2:
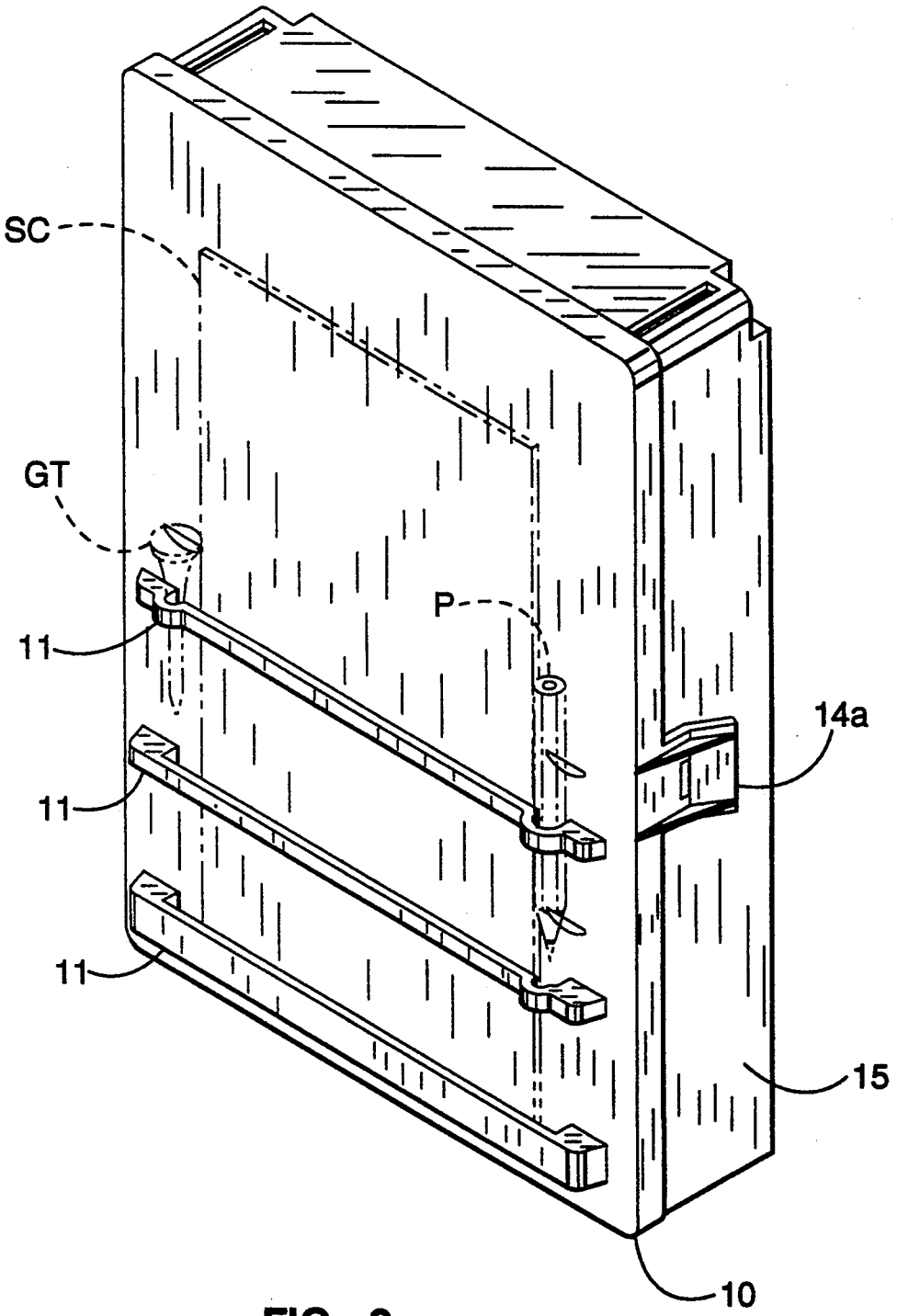
FIG. 2 is a perspective view of the subject apparatus showing the opposite side as that shown in FIG. 1.
Figure 3:
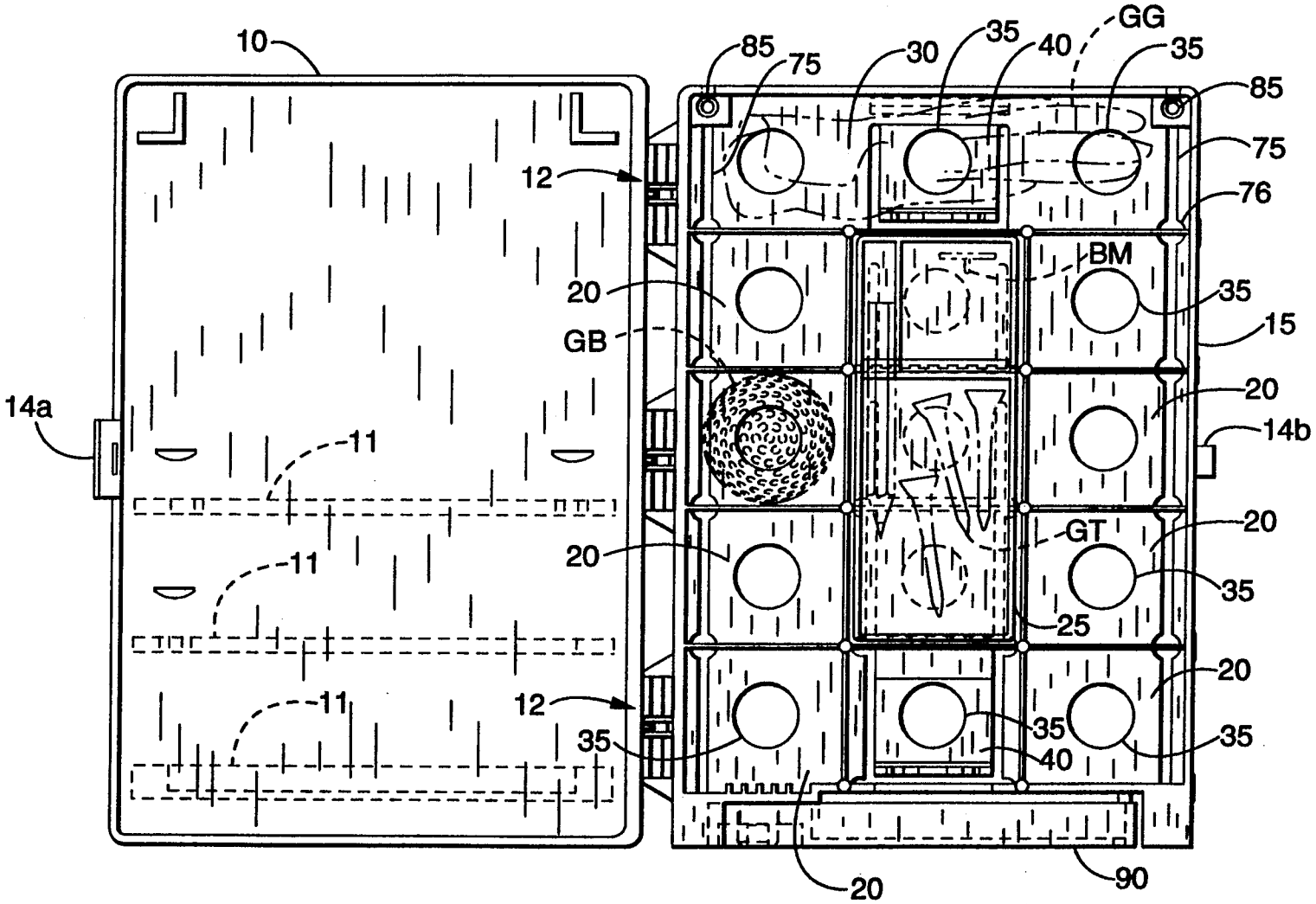
FIG. 3 is planar a view of the subject apparatus showing the cover member in the open position.
Figure 5:
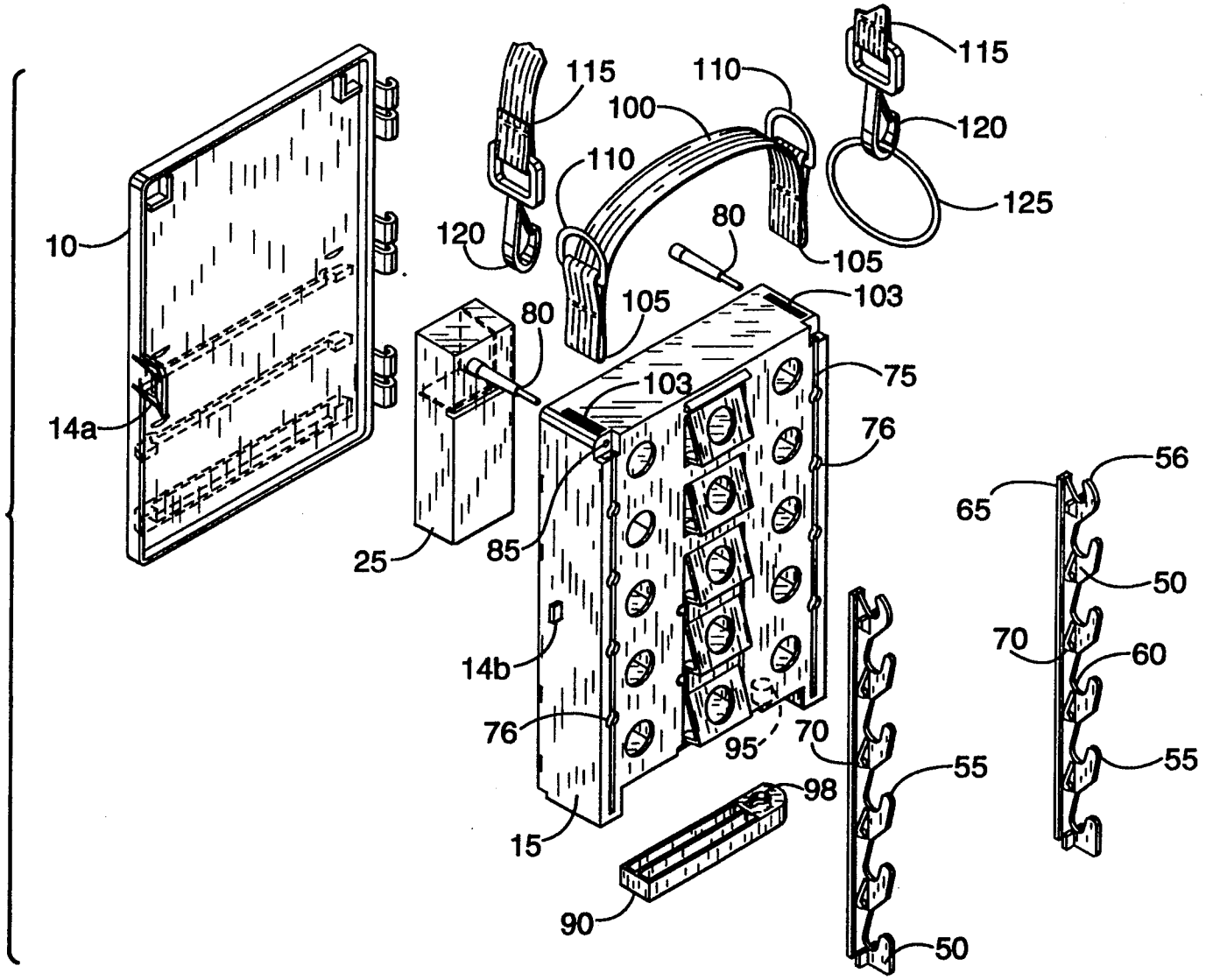
FIG. 5 is an exploded view of the subject apparatus.
Figure 6:
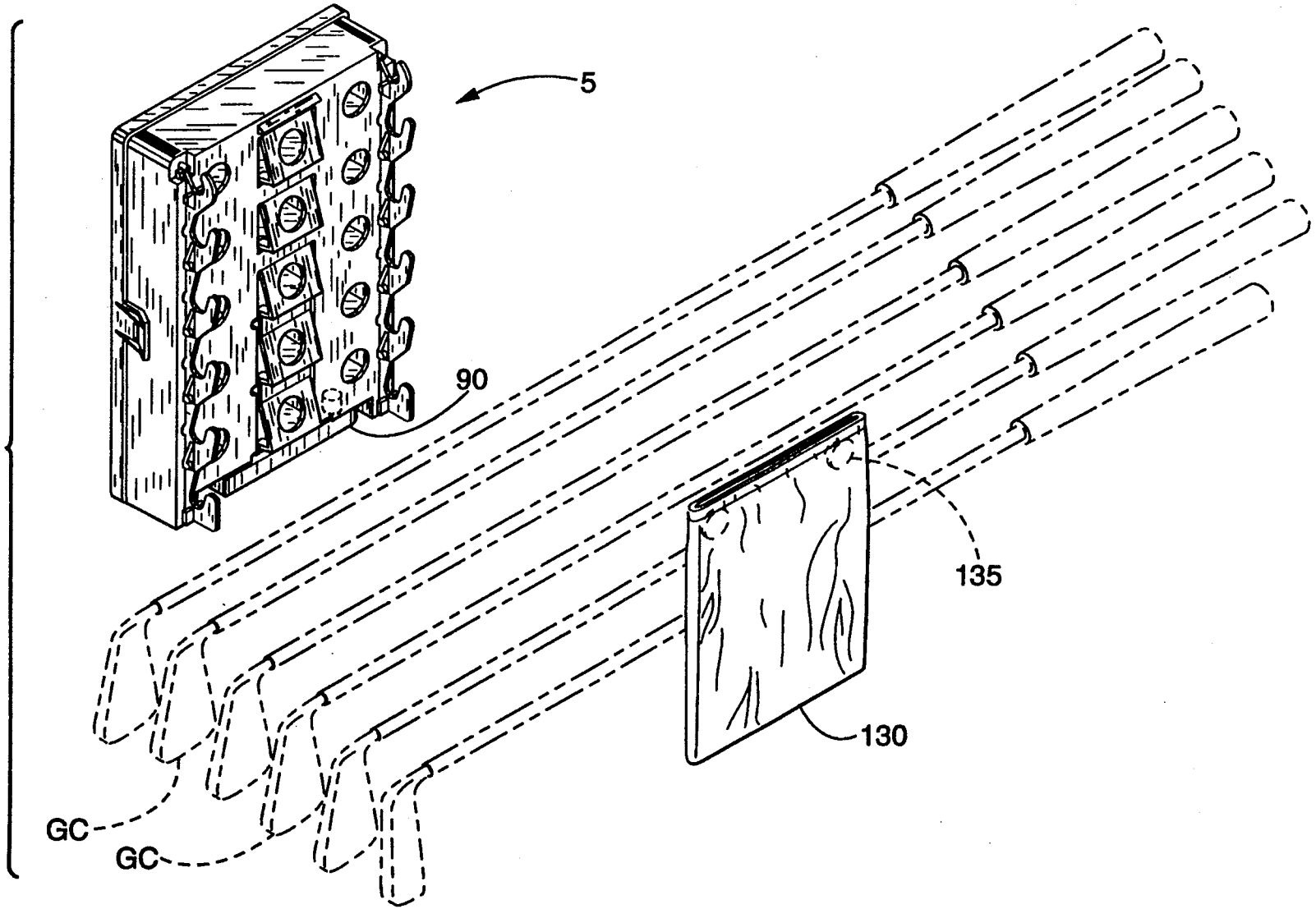
FIG. 6 is a perspective view of the subject apparatus showing a carrying bag and the orientation of golfing clubs that are to be secured to the subject invention.
Figure 7:
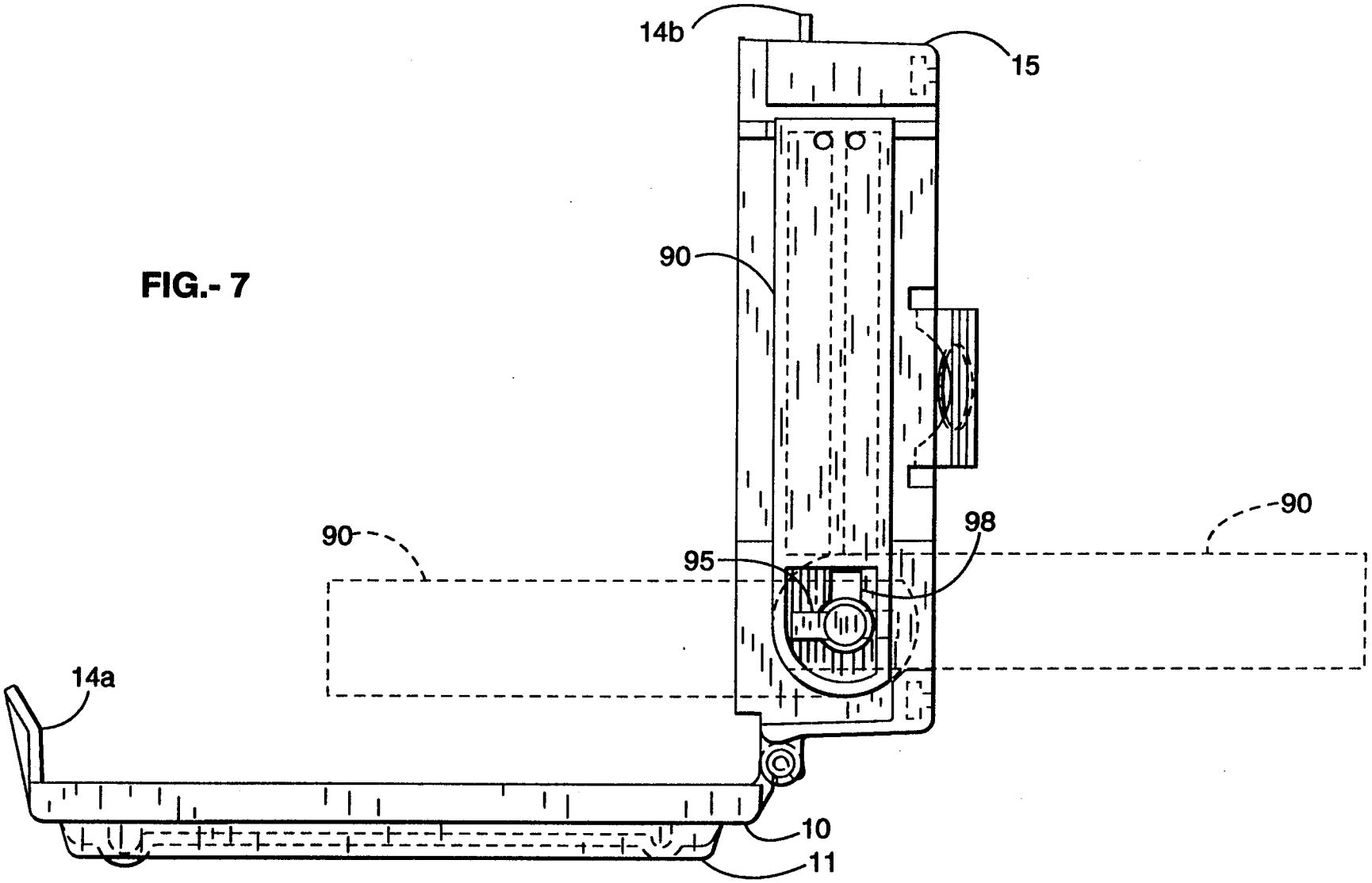
FIG. 7 is a bottom view of the subject apparatus showing the rotatable supporting foot.

Referring now to FIGS. 1–7, there is shown a preferred embodiment of an equipment carrier. Usually, but not exclusively, the equipment is associated with the sport of golf. However, another field that would find the subject apparatus handy involves fishing where lures and associated fishing items are carried, along with a fishing pole. For exemplary purposes, the subject invention will be described in terms of a golfing application. Comprising the subject invention is a generally flattened box-shaped housing having a cover member 10 and a base member 15. Generally, the cover member 10 and base member 15 are mated together by at least one hinge 12, preferably two hinges, and a latch having first 14*a* and second 14*b* halves 14*a*. It must be remembered that equivalent mating means such as sliding pieces, and the like are considered to be within the realm of this disclosure. Usually, the cover member 10 opens about the hinges 12, as seen in FIGS. 3 and 7.

The cover member 10 has a generally planar outer surface that is employed by a user as a writing surface. A score card SC and pencil P are secured to the outer surface of the cover member 10 by attachment means. Usually, the score card SC and pencil P attachment means comprises a securing bar 11, generally two securing bars 11, formed in the cover member 10. As depicted in FIGS. 2, 3, 5, and 7, the securing bar 11 projects from the outer surface of the cover member 10 and provides a pencil P securing site at each edge of the bars 11. It should be noted that not only will a writing instrument, such as a pencil P, fit under the securing bars, but a user may wish to have a pencil P under one end of the securing bars 11 and a tee under the other end of the securing bars 11. FIG. 2 illustrates, in phantom, how the score card SC and pencil P fit beneath the securing bar 11 and against the outer surface of the cover member 10.

The base member 15, usually having four side walls and a back wall, has various elements of the subject device incorporated in its structure. An internal storage volume is found within the base member 15. Means are provided in the housing, specifically in internal storage volume of the base member 15, for retaining at least one golf ball GB. Specifically, each golf ball GB is retained within a golf ball cubicle 20.

Also, associated with the housing, specifically the base member 15, is at least one additional compartment for storing small golfing items. Preferably, within the base member 15 is a golf tees GT and ball markers BM storage cell 25. The tees and markers cell 25 is formed as an integral portion of the base member 15 or, as shown in FIG. 5, as a separate element that is inserted into a receiving slot in the base member 15. Additionally, a golf glove storage cell 30 is constructed within the base member 15 to store a user's golf glove GG.

Each cubicle 20 has walls that are dimensioned to firmly grip a ball GB. Should the cover member 10 be open and the base member 15 inverted, the balls GB will not fall out. To remove a ball GB from its cubicle 20 the user inserts a finger into an aperture 35, formed in the back wall of the base member 15, and pushes the ball GB from within its cubicle 20. When the cover member 10 is closed, each aperture 35 serves an additional role of providing ventilation to the interior of the housing. Ventilation is important for drying a damp golf glove GG and wet balls GB, tees GT, and markers BM.

Means associated with the housing are provided for reversibly securing a shaft of at least one golfing club GC. One portion of the club GC securing means comprises a projection from the base member's 15 back wall. Formed in the base member's 15 back wall and projecting, in a relaxed state, away from the base member's 15 back wall outer surface is at least one and preferably a plurality of resilient members 40. Each resilient member 40 ramps out and away from the back wall of the base member 15 and terminates in an end edge or wall 42. Also used in connection with reversibly securing a golf club shaft is a fixed projection 45 located proximate the top of the base member 15 back wall surface.

Employed in conjunction with the base member's back wall projections, for reversibly securing a golf club GC shaft is a pair of elongated and generally flat mounting rails 50. Each mounting rail 50 has two opposing longitudinal borders. Extending along one of the longitudinal border is a series of angled teeth 55. At the upper end of each set of teeth 55 is a terminal tooth 56 that is more hook shaped than the other teeth 55. Between each pair of teeth 55 is a trough 60. At the upper end of each rail 50 is a terminal trough 62 that is formed after the final hooked tooth 56.

Extending along the rail's 50 other longitudinal border is an engagement ridge 65. In addition to the engagement ridge 65, each rail 50 has at least one and preferably a plurality of rail storage nubs 70. The nubs 70 project from at least one side and usually both sides of the rail 50. Both the engagement ridge 65 of a rail 50 and each nub 70 of a rail 50 are adapted to fit into and thereby engage a receiving channel 75 formed in the base member's 15 back wall. For receiving and guiding the nubs 70, nub receiving apertures 76 are provided in the receiving channel 75.

Figure 4:
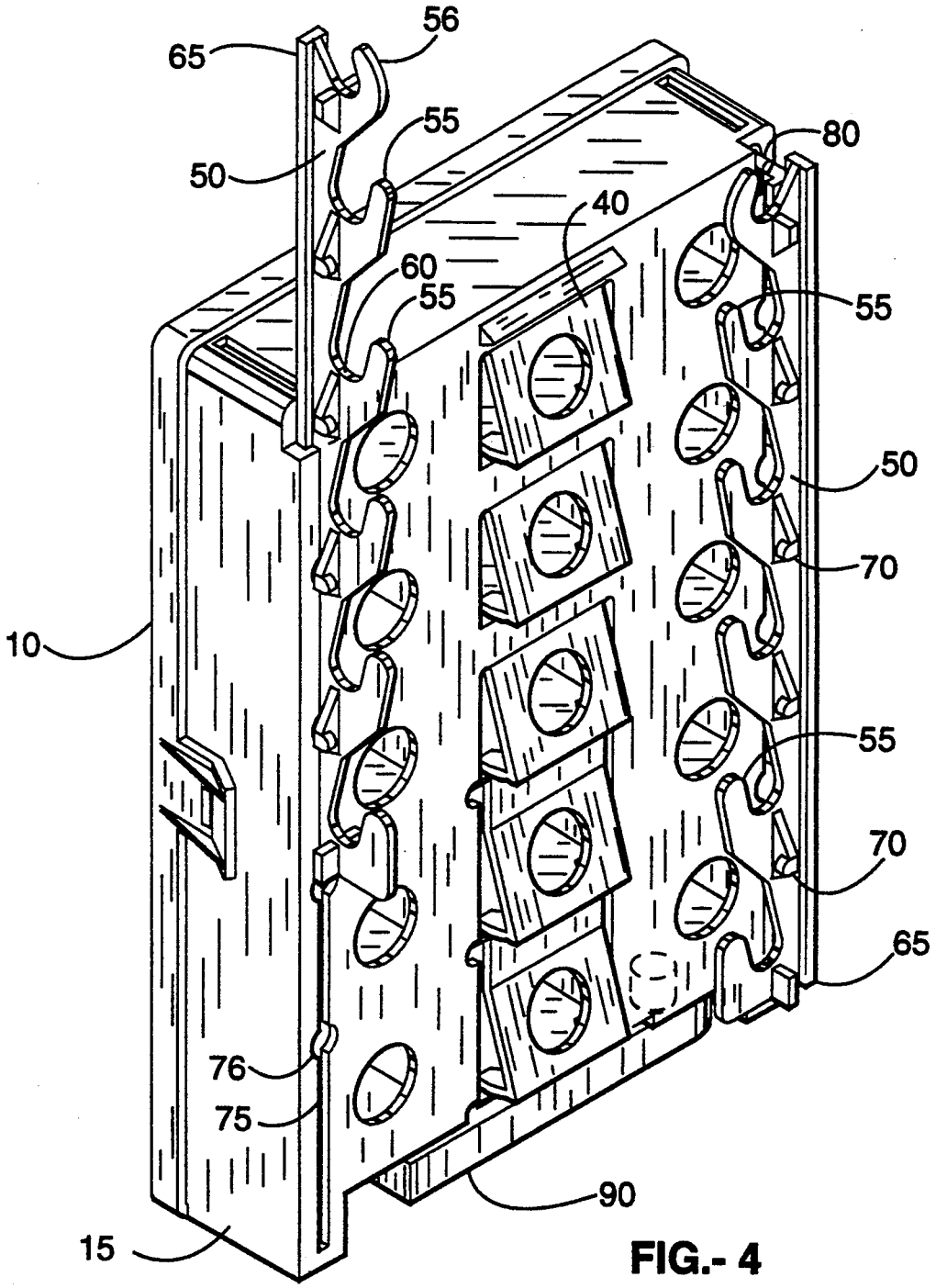
FIG. 4 is a perspective view of the subject apparatus illustrating movement of a mounting rail within a receiving channel and a mounting rail positioned for storage.

As shown in FIG. 4, each rail 50 slides within a receiving channel 75 in one of two preferred positions. On the right side of FIG. 4 is illustrated a rail 50 partially inserted along its engagement ridge 65 within a receiving channel 75 and oriented in the direction necessary for reversible securing a golf club GC shaft. On the left side of FIG. 4 is seen a rail 50 inserted along its storage nubs 70 within a receiving channel 75, thereby orienting the teeth 55 in a stored position, against the base member's 15 back wall. It should be noted that the rail storage nubs 70 are usually on both sides of each rail 50 to generate a symmetrical rail 50 that is usable in either receiving channel for use in club securing and storage.

Reversible anchoring means are included to prevent a mounting rail 50 from accidentally slipping out of a receiving channel 75. Preferably, although other equivalent means are considered to be within this disclosure, the reversible anchoring means is a locking pin 80, as seen most clearly in FIG. 5. Preferably, a base member locking pin aperture 85 is located proximate the top channel 75 end for receiving the a locking pin 80. The end of the locking pin 80 projects through the base member's 15 back wall to hold the rail 50 within the receiving channel 75 by blocking the rail's 50 removal. Once a locking pin 80 is inserted in its aperture 85, the closed cover member 10 holds the pin 80 in place. To remove a locking pin 80 the cover member 10 is opened and the pin 80 withdrawn from its aperture 85. Preferably, to facilitate the rapid introduction or removal of a rail 50 into or from a receiving channel 75, the end of the locking pin 80 that projects through the base member's 15 back wall is retractable into the main body of the pin 80. Within the main body of the pin 80 is a resilient means, such as a spring or the like, that forces the pin end into its extended position to lock a rail 50 within a channel 75. Other pin 80 securing means are possible including threads, latches, hooks, and similar devices.

As seen in phantom in FIG. 6, several golf clubs GC are secured within the mounting rail troughs 60 and 62. When a golf club shaft is inserted within opposing troughs 60 in a pair of rails 50 the club GC is reversibly secured by means of a resilient member 40 snapping over the shaft. When snapped over the shaft, the resilient member's end edge or wall 42 presses against the shaft and forces the shaft into the troughs 60. To release a club shaft, the user slightly depresses the securing resilient member 40 and the shaft is pulled easily from its stored position by the user. The last upper paired terminal troughs 62, with a slight hook to each, receive a shaft and secures it by having the shaft wedged under the lower portion of the stationary projecting member 45. Removal of a golf shaft from the terminal paired troughs 62 is accomplished by pulling the shaft away from the base member back surface and out from within the pressure fit hold between the terminal teeth 56 and the stationary projecting member 45.

As can be seen in FIG. 5, the golf clubs GC fit, preferably, within the troughs 60 and 62 in a staggered array that permits the golf club heads to be off-set from one another. Since the shaft of a golf club GC is tapered, by varying in a sequential increase the radii of the troughs 60 and 62 the shafts fit in a staggered array to the subject apparatus.

When a user sets the subject apparatus down on the ground or a floor, a rotatable supporting foot 90 is provided to assist the carrier 5 in standing erect. As shown in particular in FIG. 7, projecting from the bottom of the base member 15 is supporting foot key member 95 that mates with the supporting foot 90 via entering a keyway 98 in the foot 90. When the cover member 10 is opened (as in FIG. 7) and the foot 90 is oriented perpendicular to the back wall of the base member 15 and extending away from the inner storage elements of the base member 15 (in FIG. 7 shown in dashed lines towards the bottom of the figure) the key member 95 receives or releases the keyway 98. Rotating the foot 90 towards the base member 15 secures the key 95 within the keyway 98, thereby preventing the removal of the foot 90 from the key 95. Preferably, the foot 90 fits over the key 95 with enough friction to prevent motion unless a user moves the foot 90 to a desired position. When the foot 90 is oriented for use as a pedestal for supporting the subject apparatus, the foot 90 is rotated in generally perpendicular direction away from the base member's 15 back wall (in FIG. 7 shown in dashed lines towards the top of the figure).

Each locking pin 80 serves a dual role of providing reversible means for anchoring both a mounting rail 50 within a receiving channel 75 and a handle member 100 to the base member 15. After inserting an attachment loop 105 formed in the handle 100 through a receiving slot 103 in the base member 15, each pin 80 fits through the attachment loop 105 to reversibly anchor the handle 100 to the base member 15. Also secured to the handle 100 are shoulder strap attachment rings 110. A shoulder strap 115, with handle attachment means, usually clips 120, fastens to the rings 110. Optionally included is a towel holding means, generally a towel ring 125 into which a towel is inserted.

The subject apparatus is ideally suited to include and does include in one embodiment a general purpose storage pouch 130. The pouch 130 has an entrance proximate its top edge. To reversibly fasten the pouch 130 to the base member 15 at least one button 135 is secured to the pouch 130. Each button 135 fits within one of the base member apertures 35. The weight of the pouch 130 forces the button 135 downward and firmly secures it within the base member aperture 35. To remove the pouch 130 the pouch 130 is lifted and the button 135 withdrawn from the base member aperture 35.

Optionally, a user may wish to couple the subject device to a golf cart or the like. To facilitate the coupling, a bracket mounting may be provided in the base member 15 and an appropriate mating element anchored to the cart. The construction of the coupling could function along the lines of the rail 50 and channel 75 interaction, however, other equivalent means are considered to be within the purview of this disclosure.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. An equipment carrier, comprising:

a) a housing having a base member and a cover member;

b) means associated with said base member for retaining within said housing a plurality of small objects; and c) means associated with said base member for reversibly securing a shaft of an elongated member.

2. A golfing equipment carrier, comprising:

a) a housing having a base member and a cover member;

b) means associated with said base member for retaining within said housing at least one golf ball; and c) means associated with said base member for reversibly securing a shaft of at least one golf club.

3. A golfing equipment carrier according to claim 2, further comprising a compartment within said housing for storing small golfing items.

4. A golfing equipment carrier according to claim 2, further comprising a detachable supporting foot pivotally secured to said housing, wherein said foot is rotated to produce a pedestal for supporting said carrier.

5. A golfing equipment carrier according to claim 2, further comprising an interchangeable handle member.

6. A golfing equipment carrier according to claim 2, further comprising a storage bag detachably secured to said housing.

7. A golfing equipment carrier according to claim 2, further comprising means associated with said cover for securing a score card and writing instrument.

8. A golfing equipment carrier, comprising;

a) a housing having a cover member mated to a base member, wherein said base member has an internal storage volume;

b) means associated with said internal storage volume for retaining at least one golf ball; and c) means detachably associated with said base member for reversibly securing a shaft of at least one golf club.

9. A golfing equipment carrier according to claim 8, further comprising a compartment within said housing for storing small golfing items.

10. A golfing equipment carrier according to claim 8, further comprising a supporting foot pivotally secured to said base member.

11. A golfing equipment carrier according to claim 8, further comprising an interchangeable handle member.

12. A golfing equipment carrier according to claim 8, further comprising a storage bag detachably secured to said housing.

13. A golfing equipment carrier according to claim 8, further comprising means associated with said cover for securing a score card and writing instrument.

14. A golfing equipment carrier, comprising:

a) a housing having a cover member hinged to a base member and secured in a closed position by a latch associated with said cover and base members, wherein said base member has an internal storage volume;

b) a plurality of cubicles within said internal storage volume for retaining a golf ball within each said cubicle;

c) means detachably associated with said base member for reversibly securing a shaft of each of a plurality of golf clubs;

d) a compartment within said base member for storing small golfing items;

e) a supporting foot pivotally secured to said base member;

f) an interchangeable handle member; and g) means associated with said cover for securing a score card and writing instrument.

15. A golfing equipment carrier according to claim 14, further comprising a storage bag detachably secured to said housing.

16. A golfing equipment carrier according to claim 14, wherein said reversible shaft securing means comprises:

a) a pair of elongated and generally flat mounting rails with each said mounting rail having first and second opposing longitudinal borders, wherein said mounting rail comprises:

an engagement ridge extending along said first longitudinal border;

a plurality of teeth comprising said second longitudinal border, wherein said golf club shaft fits within a trough proximate said teeth;

b) a pair of receiving channels formed in said base member, wherein each of said receiving channels slidably receives said engagement ridge on one of said pair of mounting rail; and c) means associated with said base member for reversibly securing said golf club shaft within said trough between said two teeth in each said mounting rails.

17. A golfing equipment carrier according to claim 16, wherein said mounting rail further comprises at least one rail storage nub projecting from said rail, wherein said nub fits within said receiving channel when said rail is stored.

18. A golfing equipment carrier according to claim 16, wherein said golf club reversible securing means comprises a resilient member projecting in a relaxed state away from said base member, whereby when said golf club shaft is within said trough proximate said teeth, said resilient member blocks said golf club shaft from being removed from said trough and when said resilient member is depressed towards said base member said golf club shaft is removable from said trough.

19. A golfing equipment carrier according to claim 16, further comprising means for reversibly anchoring both said handle member to said base member and both said mounting rails within said receiving channels.

20. A golfing equipment carrier according to claim 19, wherein said reversible anchoring means comprises a pair of locking pins, wherein each of said pair of locking pins slides within a base member locking pin aperture, thereby securing a handle loop and blocking said engagement ridge from exiting said receiving channel.

* * * * *